US006055388A

United States Patent [19]

Watanabe et al.

[11] Patent Number: 6,055,388

[45] Date of Patent: Apr. 25, 2000

[54] IMAGE FORMING APPARATUS AND METHOD FOR OBTAINING APPROPRIATE TONER DENSITY

[75] Inventors: Shigeru Watanabe; Masaru Tanaka, both of Yokohama; Haruji Mizuishi, Tokyo; Kenzou Tatsumi, Yokohama; Toshitaka Yamaguchi, Ohmiya; Takeo Suda, Tokyo; Hiroshi Yoshinaga, Ichikawa; Ken Amemiya, Tokyo; Mayumi Oh-Hori, Kawasaki, all of Japan

[73] Assignee: Ricoh Company, Ltd., Tokyo, Japan

[21] Appl. No.: 09/054,510

[22] Filed: Apr. 3, 1998

[30] Foreign Application Priority Data

Apr. 3, 1997 [JP] Japan ..... 9-085163

[51] Int. Cl.[7] ..... G03G 15/10

[52] U.S. Cl. ..... 399/58; 399/59; 399/61; 399/62; 399/253

[58] Field of Search ..... 399/13, 58, 59, 399/61, 62, 63, 81, 253, 252, 97

[56] References Cited

U.S. PATENT DOCUMENTS

| | | | |
|---|---|---|---|
| 5,077,584 | 12/1991 | Tanaka et al. . | |
| 5,103,264 | 4/1992 | Bhagat | 399/253 |
| 5,109,254 | 4/1992 | Oka et al. . | |
| 5,557,382 | 9/1996 | Tatsumi et al. . | |
| 5,594,529 | 1/1997 | Yamashita et al. | 399/8 |
| 5,594,535 | 1/1997 | Beaufort et al. | 399/262 |
| 5,745,822 | 4/1998 | Nishimura et al. | 399/106 |
| 5,839,018 | 11/1998 | Asanuma et al. | 399/43 |

FOREIGN PATENT DOCUMENTS

| | | |
|---|---|---|
| 60-84559 | 5/1985 | Japan . |
| 62-138876 | 6/1987 | Japan . |
| 3-87870 | 4/1991 | Japan . |
| 4-24674 | 1/1992 | Japan . |
| 6-43746 | 2/1994 | Japan . |
| 7-134491 | 5/1995 | Japan . |

*Primary Examiner*—William Royer
*Assistant Examiner*—Greg Moldafsky
*Attorney, Agent, or Firm*—Oblon, Spivak, McClelland, Maier & Neustadt, P.C.

[57] ABSTRACT

An image forming apparatus includes an image bearing member, a latent image forming device that forms a latent image on the image bearing member, a developing device that develops latent image on said image bearing member to a toner image with a two-component developer, and a toner density detecting device that detects toner density of the two-component developer in which the toner image is formed and outputted as a visible image onto a transfer member. A control device is provided for agitating the developer for a predetermined time period during an initial setting is performed for the developer, detecting a toner density of said developer after the predetermined agitation, and performing an abnormal process when a result of the detection is out of the predetermined range. A corresponding method recovers from a deterioration of an amount of charge of the toner and decreased bulk of the developer, and includes the steps of detecting a developer amount with an unused-state detection switch, detecting an output value of a toner density detecting sensor, agitating the developer, measuring an agitating time period, stopping the agitating operation indicating warning, and indicating error message.

26 Claims, 12 Drawing Sheets

IMAGE FORMING APPARATUS AND METHOD FOR OBTAINING APPROPRIATE TONER DENSITY

BACKGROUND OF THE INVENTION

1. Field of the Invention

This invention relates to an image forming method and apparatus, such as a copying machine, facsimile machine, printer, and the like, and more particularly to a method using an image forming apparatus having a developing device using two-component developer.

2. Discussion of the Background

In a developer, more particularly a two-component type developer utilized in a developing device of an electrophotographic image forming apparatus, such as printer, facsimile and the like, an amount of charge of the toner and the bulk of the toner tend to decrease while the developer is left for extended periods of time without being used after being manufactured, but before using.

Thus decreased amounts of toner charge and the bulk of the toner causes the problem described below. When decreased toner charge occurs, toner tends to fall from an image and fouls a background portion of the image. The toner falls because an attracting force between the toner and a carrier decreases under a low charging state of the toner. The low charging state occurs because it takes a relatively long time for recovering the decreased charging amount of the toner by agitating the toner and the carrier in a relatively small image forming apparatus having low agitating power, even though such problems do not usually occur in relatively large image forming apparatuses having sufficiently high agitating power.

In addition, when the bulk of the toner decreases, the problem described below occurs in accordance with an erroneous detection of an output value Vt of a toner density detecting sensor. The erroneous detection of the toner density detecting sensor is explained hereinbelow. A mixing ratio of the toner to a carrier, i.e., a toner density of the developer at an early stage, such as at a time of shipment, is set regularly to a proper predetermined value, and the developer has an apparent predetermined bulk since some air gaps are contained in the developer. However, if the developer is left for extended periods of time, the measurable bulk decreases and approaches the true bulk of the developer because the air gaps in the developer tend to collapse with time. As the developer settles, the carrier that is heavier than the toner sinks to the bottom of the developing device. At this moment, the toner density detecting sensor, which is provided at a relatively low part of the developing device and measures toner density per unit area over time, has an amount of the carrier, made of a magnetizable material, pass thereby and induce a voltage value in the sensor. The output of the sensor is sent a control device that appropriately supplies toner based on the output voltage value provided by the sensor.

For example, when the developer bulk decreases, the toner density detecting sensor outputs a signal as if the toner density is low, since the toner density detecting sensor detects the carrier component that has sunk to the bottom of the developing device as a result of the developer having been left for extended periods of time. In other words, even though the overall toner density does not vary, the toner density which represents a ratio of the toner component to the carrier appears to become small, because the toner density sensor only makes a localized measurement at a position where the carrier tends to congregate. This is called an erroneous detection event made by the toner density detecting sensor. According to the erroneous detection of the toner density detecting sensor, the control device tends to compensate for the perceived lack of toner by supplying additional toner into a developing device. Consequently, the ratio of the toner to the carrier increases more than a proper rate.

A toner-containing ability of respective carrier units has a limit, and thus an excess amount of toner that cannot be contained exceeds the containing limit of the carrier, is loosened by electrostatic forces, and frees itself from the carrier of the developer—toner in this condition is so-called floating toner. Floating toner deteriorates image quality and causes toner to fall down from an image and foul the image background.

Thus, the background fouling, solid image scattering and the toner scattering occurs and results in deteriorating the image quality by decreasing of the amount of charge of the toner and decreasing the developer bulk because of prolonged storage of the developer.

Conventionally, a standard developer having a toner density that is predetermined at a time of the manufacture, for example, 2 wt % (weight percent) is used when using the developing device for the first time, replacing deteriorated and used developer. As described above, the developer that is left for extended periods of time should be supplied after recovering the predetermined amount of charge and the bulk thereof by agitating the developer, and further, the required time period for recovering the amount of charge and the bulk of the developer depends on the periods of time in which the developer is left without being used after its manufacture. Furthermore, the required time period for recovering also depends on a charging ability of the developing device. In the conventional developing device, a large amount of the developer, such as, for example, 1 kg has been set and the toner density thereof is low, such as 2 wt %, and the charging ability of the developer of the developing device has been high. Under these conditions, the amount of toner charge for the bulk of the developer is certainly able to recover to approximately the intended predetermined range therefor by performing an agitation operation for a relatively short time period, even though the developer has been left for extended periods of time. Accordingly, the toner density detecting sensor for a standard developer has been considered to output a predetermined toner density value, or the toner density has been controlled by agitating the standard developer until the predetermined toner density value has been outputted with the toner density detecting sensor.

However, in recent years, an amount of developer set in the developing device has become small, for example, about 400 g, so as to accommodate smaller developing devices. However, even though the amount of the developer set in the developing device is made small, the toner itself in the developing device is required to maintain a similar amount of toner as in the conventional developing device so as to adequately perform image forming operations.

Therefore, the trend is for toner density in the developer to get higher, for example, about 4 wt %. In such a developing device, the toner density detecting sensor does not always output the predetermined toner density value with the standard developer when the developer is agitated for a predetermined time period of practical level, for example, about 3 minutes, since the charging ability of the developing device is low. For example, when the standard developer has been left for 3 months, the toner density detecting sensor outputs a predetermined toner density value with the standard developer, however when the standard developer has been left for one year, it takes 10 minutes until the developer outputs the predetermined toner density value. Accordingly, in the developing devices that contain small amounts of the developer that is set therein and uses developer with relatively high toner density, if the predetermined toner density value has been considered to be outputted by agitating the standard developer for predetermined time period as in the conventional case, the toner density value is erroneously detected as a result. Consequently, the aforementioned shortcomings such as the toner falling down from an image and background fouling occur. On the other hand if the developer is agitated enough so that the predetermined toner density value is outputted, the agitating time period has been required to be set more than 10 minutes, which has not been practical. Further, if the standard developer is continuously agitated until the predetermined toner density is outputted, there is a possibility that the agitating time period covers a long time, such as 10 minutes, and this is considered to be an erroneous operation.

SUMMARY OF THE INVENTION

In view of the above-mentioned considerations it is an object of the present invention to overcome the above-described, and other, problems of conventional systems and methods, and to provide an image forming method and apparatus that recovers developer that has deteriorated over time so as to prevent an adverse effect on an image quality due to a decreasing amount of charge of the toner and bulk of the developer.

These and other objects may be achieved with an image forming method and apparatus according to the present invention. The apparatus includes an image bearing member, a latent image forming device that forms a latent image on the image bearing member, a developing device that develops the latent image on the image bearing member to a toner image with a two-component developer, and a toner density detecting device that detects toner density of the two-component developer in which the toner image is formed and outputted as a visible image onto a transfer member. A control device is provided for agitating the developer for a predetermined time period during an initial setting performed for the developer, detecting a toner density of the developer after the predetermined agitation, and identifying when a result of the detection is out of a predetermined range so as to take corrective action.

The image forming apparatus forms a toner image and outputs the toner image as a visible image onto a transfer member. The apparatus includes a control device that agitates the developer for a predetermined time period during the initial setting, and then re-agitates the developer for a period of time after the initial agitation of the developer is finished.

The control device may also agitate the developer until an output value of the toner density detecting device reaches a value in a predetermined range during the time in which initial setting is performed for the developer, wherein said control device stops agitation of the developer when the agitation time period exceeds a predetermined time period.

The present invention is also directed to a method for recovering a deterioration of an amount of charge of the toner and decreased bulk of the developer. Steps in the method include, detecting an unused-state detection switch, detecting an output value of a toner density detecting sensor, agitating the developer, measuring an agitating time period, stopping the agitating operation, indicating warning, and indicating an error message.

BRIEF DESCRIPTION OF THE DRAWINGS

A more complete appreciation of the invention and many of the attendant advantages thereof will be readily obtained by referring to the following detailed description when considered in connection with the accompanying drawings, wherein:

FIG. 11 is a plan view showing terminals, connectors etc. for power supply, unused-state detection or the like;

DESCRIPTION OF THE PREFERRED EMBODIMENTS

Figure 1:
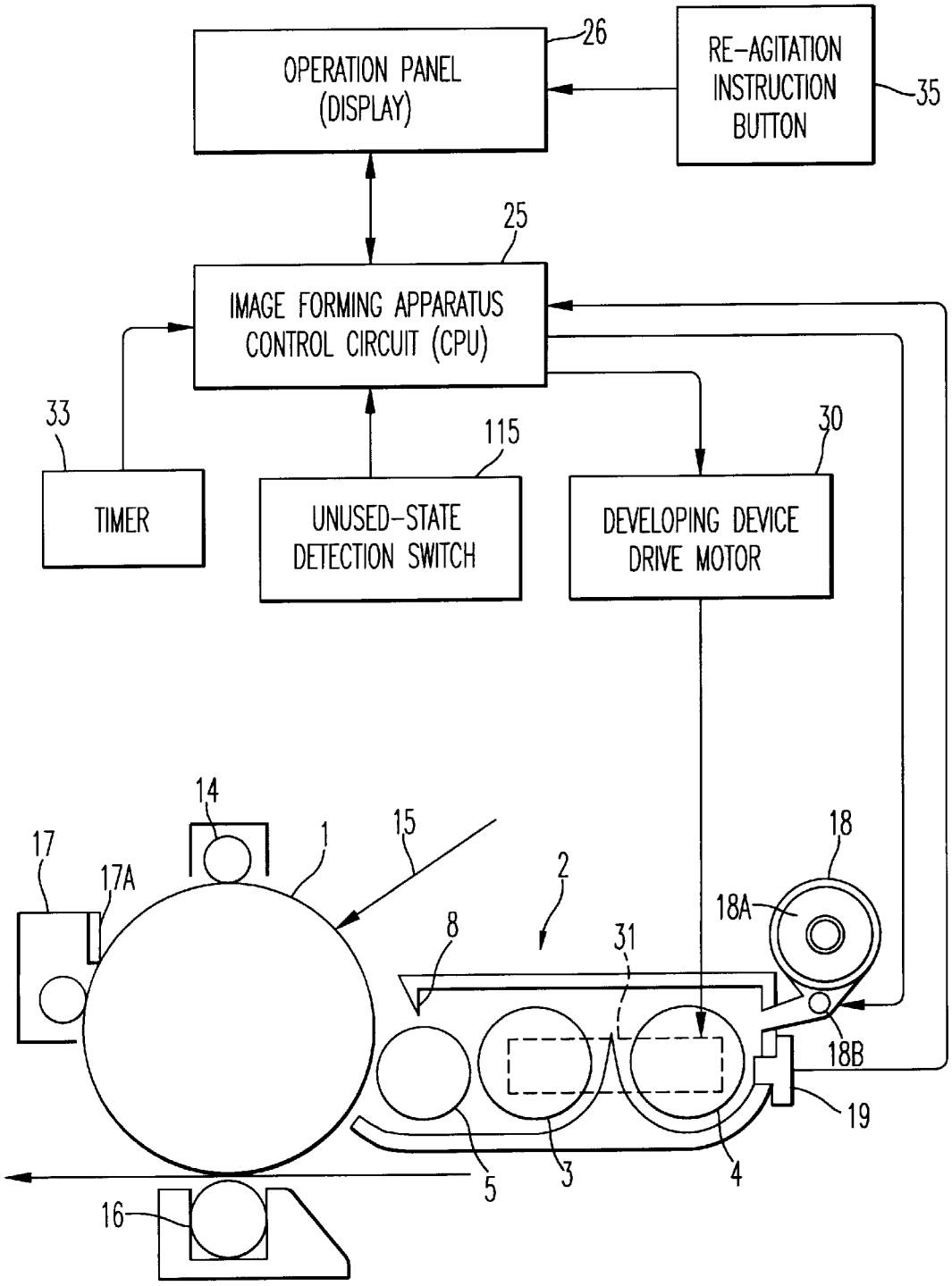
FIG. 1 is a block diagram of a control device configured to control an operational mode performed according to the present invention.

An embodiment of the present invention applied to an image forming apparatus is explained hereinafter.

An Example of the Image Forming Apparatus to which the Present Invention is Applied A. Construction In FIG. 5, a photoconductive element 1, which serves as an image bearing member and has a drum-shape, is rotated in a direction indicated by the illustrated arrow. A developing device 2 is provided with a casing and is positioned at a predetermined position relative to the photoconductive element 1. The developing device 2 is placed at a longitudinal direction that is parallel to the rotating shaft of the photoconductive element 1 in a direction perpendicular to the paper surface of this specification while a developing sleeve 5 is held for rotation and disposed adjacent to the photoconductive element 1 at an opening of the developing device 2.

Next to the developing sleeve 5, a first member 3 and a second member 4 for agitating and conveying the developer are held for rotation and disposed in this order, and a plurality of blades that agitate and convey a two-component developer composed of a toner and a carrier are provided with the first member 3 and the second member 4 respectively. The first member 3 and the second member 4 agitate and convey the two-component developer by being rotated and driven in an interlocking fashion with each other by a drive section 31 (refer to FIG. 1) that is composed of an engaging mechanism having gears mounted on the first member 3 and the second member 4 respectively, and circulate the two-component developer in the developing device 2 through the developing sleeve 5.

A relatively long opening 6 is formed at an upper part of a specific area extending across the first member 3 and the second member 4 of the developing device 2 and into the page, and a slender box-shaped developer container 7 is detachably mounted on the developing device 2 and communicating therewith. Hereupon, the developer container 7 is detachably mounted on the developing device 2 by attaching the developer container 7 to the developing device 2, by inserting the convex hooking portion 7*a* into a hooking portion 2*a*, and hooking the hooking convex portion 7*b* to the hooking portion 2*b*, in the hooking convex portion 7*a* and 7*b*, which project from the side part of the developer container 7.

Figure 5:
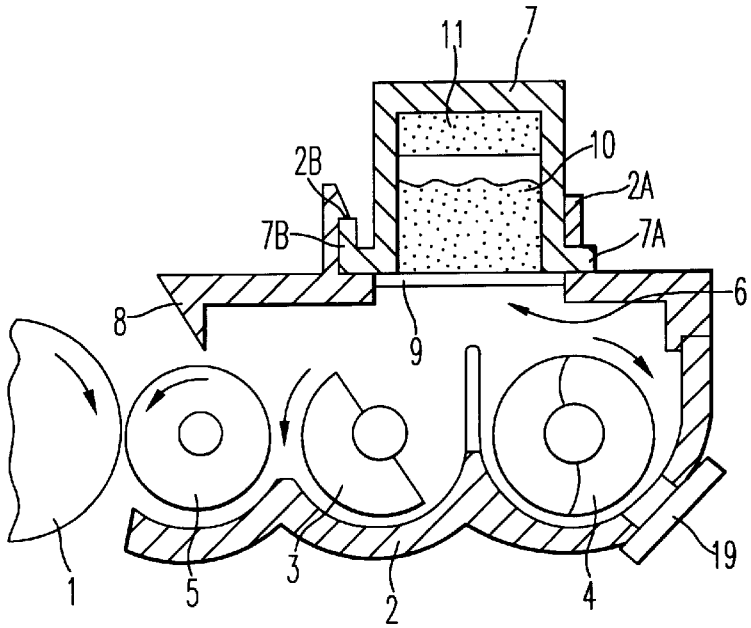
FIG. 5 is a cross sectional view of a developing device on which a developer container is mounted.

FIG. 5 shows a system state just after mounting the developer container 7 onto the developing device 2. An opening of the developing device 7 is set in a down-facing position and the developer container 7 is sealed by shutting the opening with a heat seal 9 as a sealing member. The developer 10 and a dehumidifying agent 11 are sealed in an inner part of the developer container 7. In this sealed state, the developer 10 is free to move within the developer container 7 without losing any of the developer, and the dehumidifying agent 11 does not fall down when the developer container 7 is mounted on the developing device 2 since the dehumidifying agent 11 is fixed by an adhesive or the like to the bottom position of an opposite side of the opening 6 where the heat seal 9 is provided.

The heat seal 9 can easily be removed from under the developer container 7 on the developing device 2 as shown in FIG. 5, by pulling the heat seal 9. If the heat seal 9 is pulled out, the interior of the developer container 7 opens to the interior of the developing device 2, but the dehumidifying agent 11 remains in the developer container 7, even though the developer 10 in the developer container 7 falls down into the developing device 2. Thus, the developer container 7 is in a sealed state in which the developer 10 and the dehumidifying agent 11 are sealed inside of the developer container 7 until the heat seal 9 is pulled out.

Figure 6:
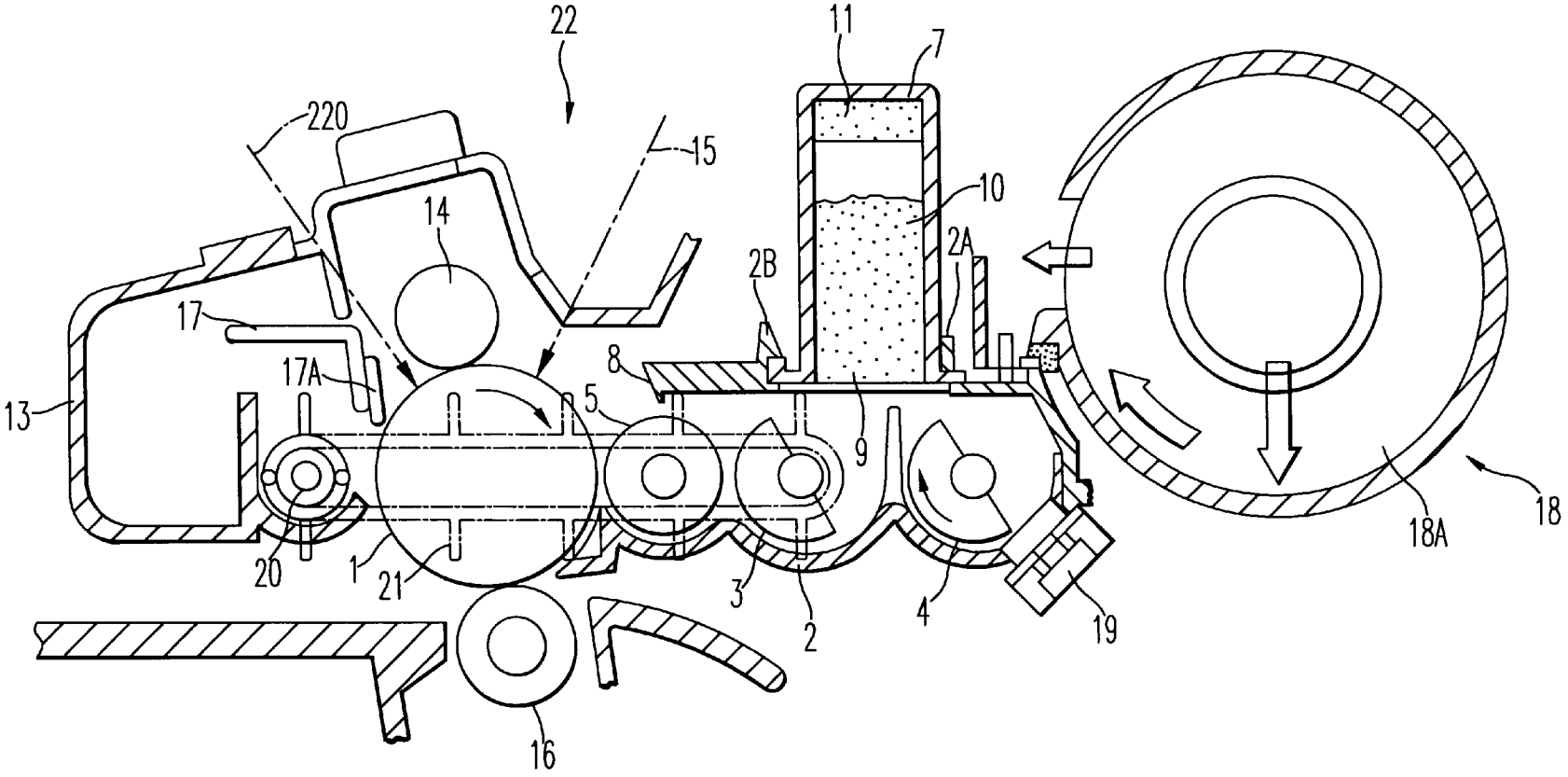
FIG. 6 is a cross sectional view of a photoconductive element unit.

The toner in the developer which falls into the developing device 2 is consumed during each developing operation, and unused toner is supplied into the developing device 2 from a toner bottle 18*a* in a toner supplying device 18, shown in FIG. 6, so as to supplement the consumed toner. Since the developer container 7 communicates with the developing device 2, the dehumidifying agent 11 works to dehumidify the developing device 2, and thus charge decrease on the developer 10 in the developing device 2 is prevented from occurring due to humidity.

In FIG. 6, a photoconductive element unit 22 includes the developing device 2, which is constructed with a photoconductive element case 13 that supports the photoconductive element 1 in a body. The photoconductive element 1, which rotates in a clockwise direction, is uniformly charged first by a charging roller 14 as a charging device, and a light 15 that is intensity-modulated with image information from a writing device as an exposing device (not shown) for exposing the photoconductive element 1 is irradiated on the photoconductive element 1, and image information is thus written and an electrostatic latent image is formed on the photoconductive element.

The electrostatic latent image on the photoconductive element is developed to a toner image with a two-component developer by the developing sleeve 5 at the developing device 2. A transfer bias is applied to a transfer roller 16 as a transfer device by a power source (not shown). The toner image on the photoconductive element 1 is transferred onto the transfer sheet which is fed from a sheet feeding device by a transfer roller 16 while the transfer sheet passes through the nip part between the transfer roller 16 and the photoconductive element 1, and the sheet with a toner image fixed thereon by a fixing device (not shown) after being separated from the photoconductive element 1 is discharged to a tray.

Residual toner on the photoconductive element 1 is removed with a cleaning blade 17*a* of a cleaning device 17 after transferring of the toner image, and the charge on the photoconductive element 1 is discharged by a discharging light 220 from a discharger (not shown). The residual toner that is scraped off from the photoconductive element 1 by the cleaning blade 17*a* falls down into the collecting container, which is provided at a part of the photoconductive element case 13, and conveyed to an end portion side of the longitudinal direction of a conveying screw 20 by rotation thereof. The residual toner is further conveyed to the developing device 2 by a recycle belt 21. The toner conveyed to the developing device 2 side is conveyed to the developing sleeve 5 by being mixed with unused toner from a toner supplying device 18 by the first member 3 and the second member 4.

The developer container 7 is detachably mounted on the developing device 2 as mentioned above. FIG. 6 shows a system state before the heat seal 9 is pulled out, such that the developer 10 is still inside the developing device 7. The developer 10 in the developer container 7 falls down into the developing device 2 once the heat seal 9 is pulled out from the developer container 7, and the developer 10 is circulated in the developing device 2, while being agitated by the first member 3 and the second member 4, being conveyed through the developing sleeve 5. The dehumidifying agent 11 works to dehumidify the developing device 2 after the heat seal 9 is pulled out.

In the opening of the developing device 2 formed at an upper part of the second member 4, toner in the toner bottle 18*a* is supplied through a path indicated by arrows from a toner supplying device 18, and the toner consumed during each developing operation is supplemented. A toner density detecting sensor 19 as a toner density detecting device detects toner density of the two-component developer in the developing device 2. For example, the toner density of the two-component developer is detected by detecting a permeability of the two-component developer in the developing device 2, and the amount of the toner supplied to the developing device 2 from the toner bottle 18*a* of the toner supplying device 18 is controlled as described later.

Figure 7:
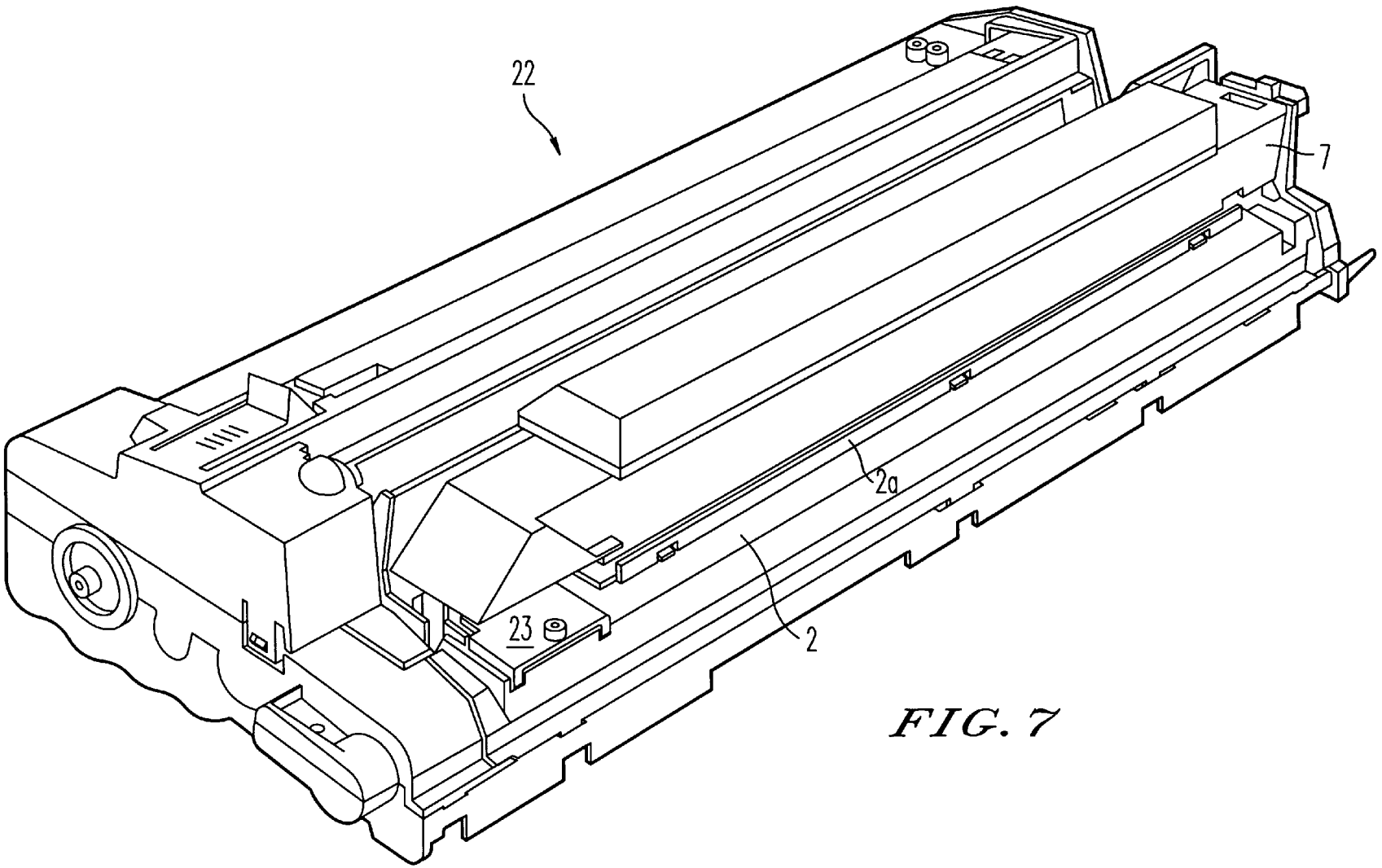
FIG. 7 is a perspective view of the photoconductive element unit with a developer container mounted thereon.
Figure 8:
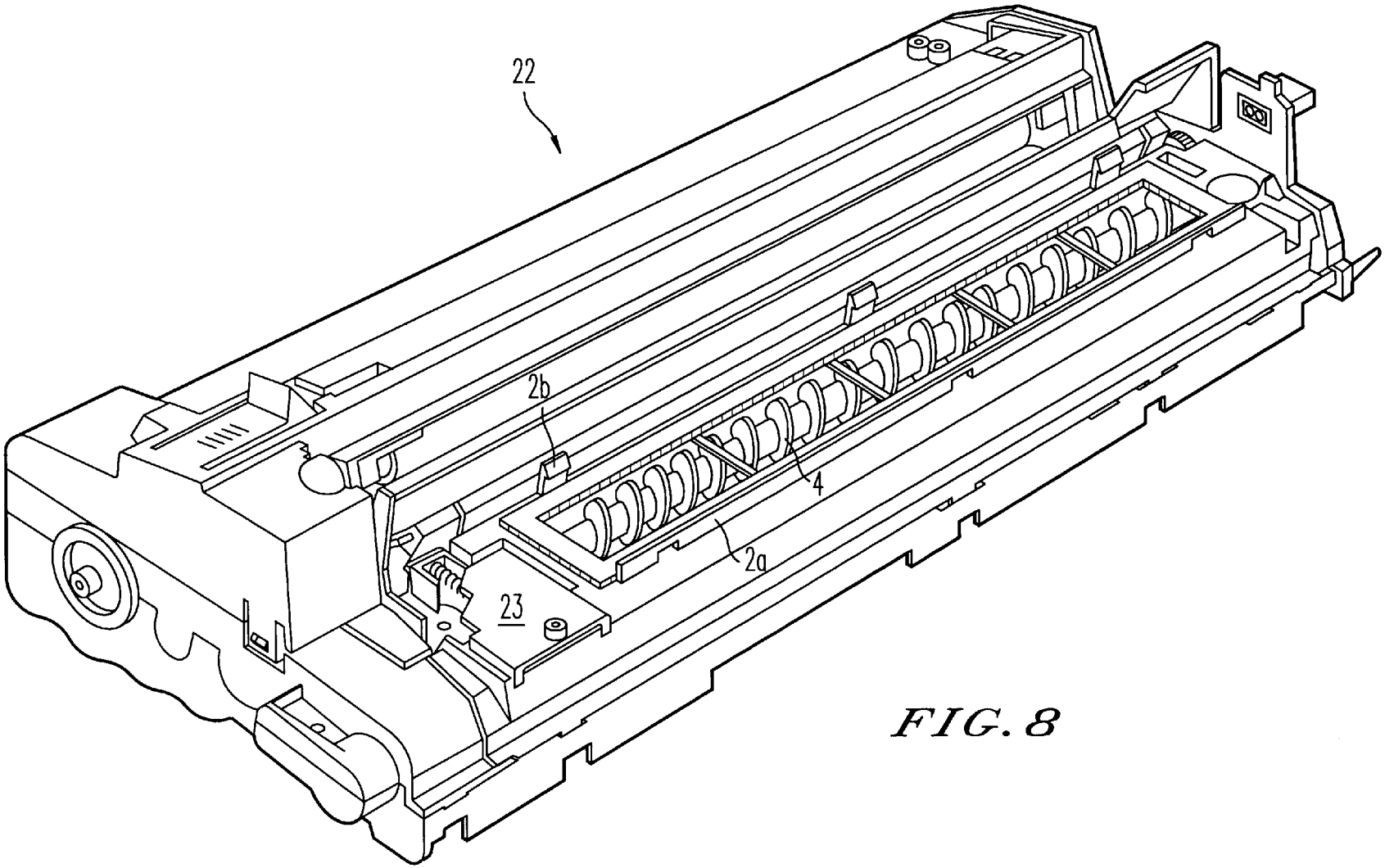
FIG. 8 is a perspective view of the photoconductive element unit when the developer container is detached from the photoconductive element unit as shown in FIG. 7.

FIGS. 7 and 8 show an outer view of the photoconductive element unit 22. FIG. 7 shows the developer container 7 mounted on the developing device 2, and FIG. 8 shows the developer device 2 with the developer container 7 detached.

As described above, the hooking convex portion 7*a* and 7*b* is formed on the developing device 2. The hooking portions and 2*b* are formed on the developing device 2 for engaging with the hooking convex portion 7*a* and 7*b*, and according to this engagement, the developer container 7 can detachably be mounted on the developing device 2.

Figure 9:
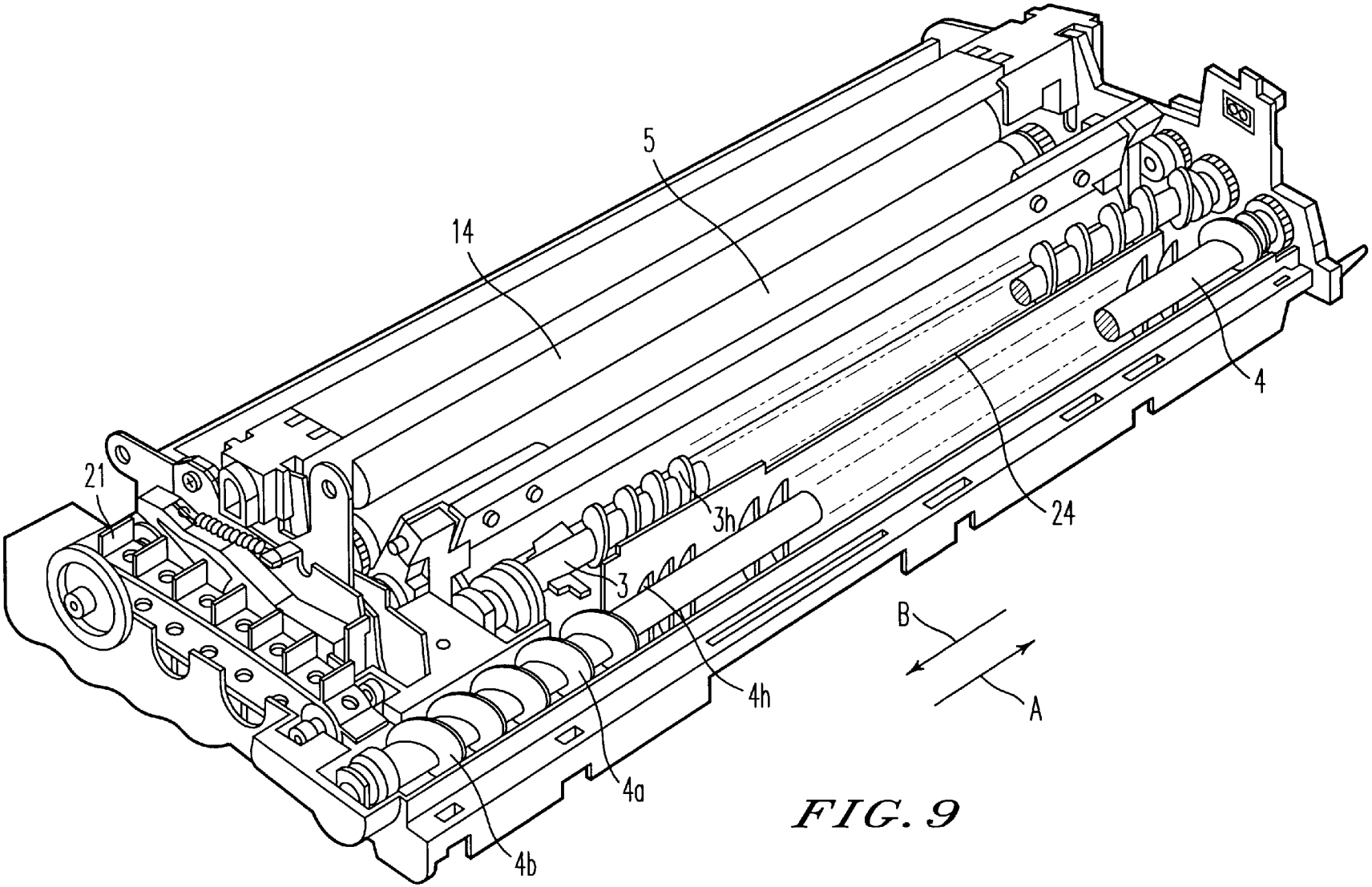
FIG. 9 is a perspective view of a developer unit from which an upper cover is detached.

As shown in FIG. 9, the second member 4 is extended longer than the first member 3 towards an outside direction, and at the extended part, there is formed a screw. A plurality of half-cut oval-shaped chip plates 4*h* are provided at an incline relative to a rotating shaft of the second member 4 at an inner side of the screw-formed part. The developer is agitated in accordance with a rotation of the second member 4 and conveyed at the same time.

The conveying direction of the developer by the rotation of the second member 4 is indicated by an arrow A. In the same manner, similar chip plates 3*h* are formed on the first member 3 corresponding to where the chip plates 4*h* are formed on the second member 4. The blades 3*h* formed on the first member 3 have an inclination contrary to the chip plates 4*h* of the second member 4 with reference to the rotating shaft of the first member 3, and the developer is conveyed in a direction indicated by an arrow B according to the rotation of the first member 3.

A partition plate 24 is provided between the first member 3 and the second member 4 so that the first member 3 and the second member 4 are separated with the partition plate 24. The developing sleeve 5 has a secured shaft inside thereof around which a 5-pole magnet is disposed, while a non-magnetizable cylindrical member as the developing sleeve which covers an outer peripheral surface of the 5-pole magnet with a slight gap therebetween is driven by a drive part (not shown). The developer is conveyed to the developing sleeve 5 by magnetic attraction of the developing sleeve 5, while being conveyed in a direction indicated by an arrow B according to the rotation of the first member 3.

The rest of the developer moves to the second member 4 through a front side gap where the partition plate 24 ends, and conveyed in direction A by the second member 4, and further, moves to the first member 3 through a rear side gap of the partition member 24. Thus, the developer basically circulates through a loop-like path around the partition member 24 by the first member 3 and the second member 4. The developing sleeve 5 conveys the developer by magnetically attracting the developer with the magnet disposed inside as the developing sleeve rotates. The amount of the developer on the developing sleeve 5 is limited in a predetermined value with a doctor blade 8, and the developer develops an electrostatic latent image on the photoconductive element 1 when passing between the developing sleeve 5 and the photoconductive element 1.

Hereupon, the toner in the toner bottle 18*a* is supplied into the developing device 2 in an open state of an open/shut lid 23 as shown in FIGS. 7 and 8. A toner supplying position of the developing device 2 is placed above a screw which is formed on the second member 4 shown in FIG. 9, i.e., an outside part of the partition plate or chip plates 4*h*. At a screw part 4*b*, which is outside of the screw part 4*a* in a longitudinal direction, used toner that was scraped off from the photoconductive element 1 is conveyed with the recycle belt 21 for recycling.

Therefore, the used toner is conveyed to the screw part 4*b* of the second member 4, and the unused toner is supplied into the used toner at the screw part 4*a*. Consequently, both of the used toner and the unused toner are conveyed into the developer in the aforementioned loop-like circulation path, and further, agitated and conveyed therethrough by the chip plates 4*h*. Hereupon, the charging state of the toner is insufficient at an early stage of agitation. Since providing toner with insufficient charging amount across the partition plate for development should be prevented, a part of the partition plate 24 where the toner in early stage of the agitation flows is formed higher than the other part.

As shown in FIG. 1, the toner supplying device 18 supplies toner into the developing device 2 from the toner bottle 18*a* by an activation of the toner supply drive part 18*b* which is constructed with a motor, clutch, and the like. The toner supply drive part 18*b* is controlled by an image forming apparatus control circuit 25 as a control device composed of a CPU. An operation panel 26 includes an operation part composed of a plurality of keys, and a display viewable by an operator. The image forming apparatus control circuit 25 performs the aforementioned image forming operation or the like by controlling each part of the image forming apparatus using an input signal from a toner density detecting sensor 19, operation panel 26 and the like. The image forming apparatus control circuit 25 performs toner supply control, control relevant to the present invention, and the like.

Next, an unused-state detection mechanism for the photoconductive element unit 22 is explained.

Figure 10:
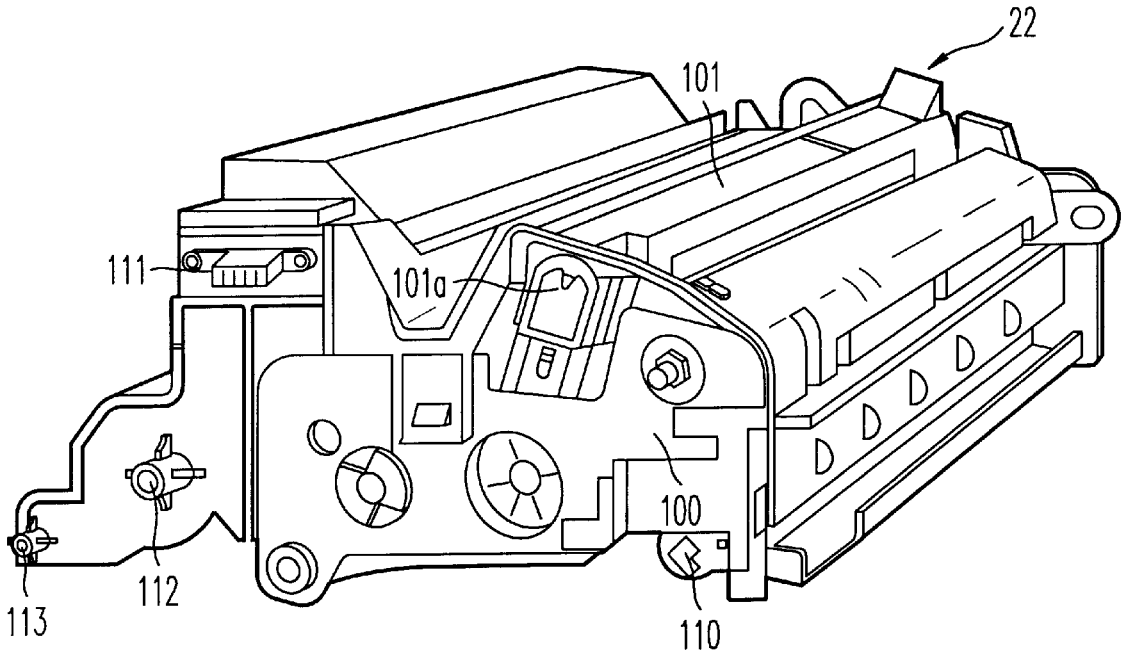
FIG. 10 is a perspective view showing an outline of a photoconductive element unit image forming unit.
Figure 11:
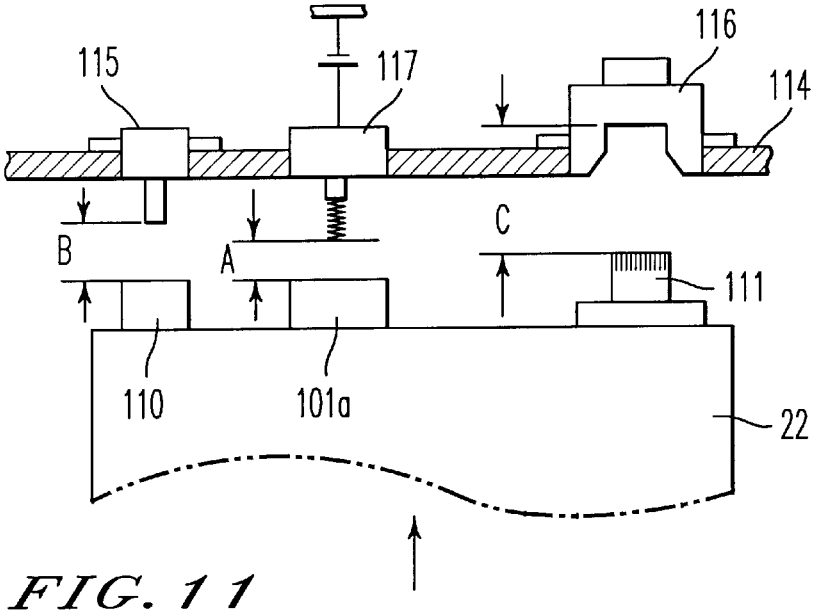
Figure 12:
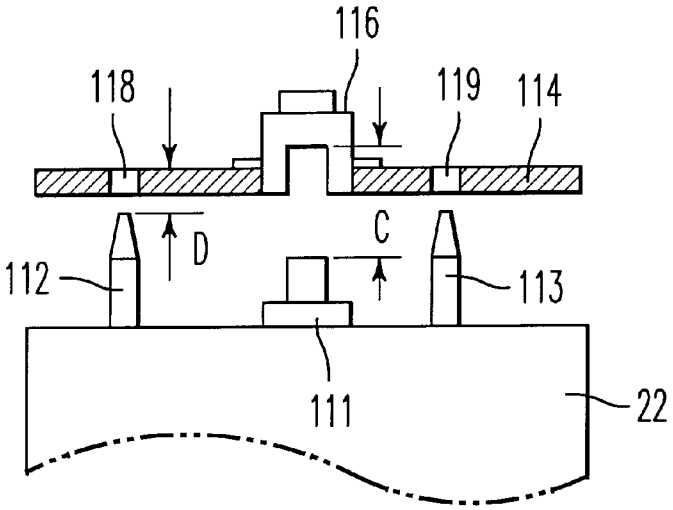
FIG. 12 is a side view showing a relationship of a plug connector for setting-detection and guide projections for an inserting guide of the main body of the image forming apparatus.
Figure 13:
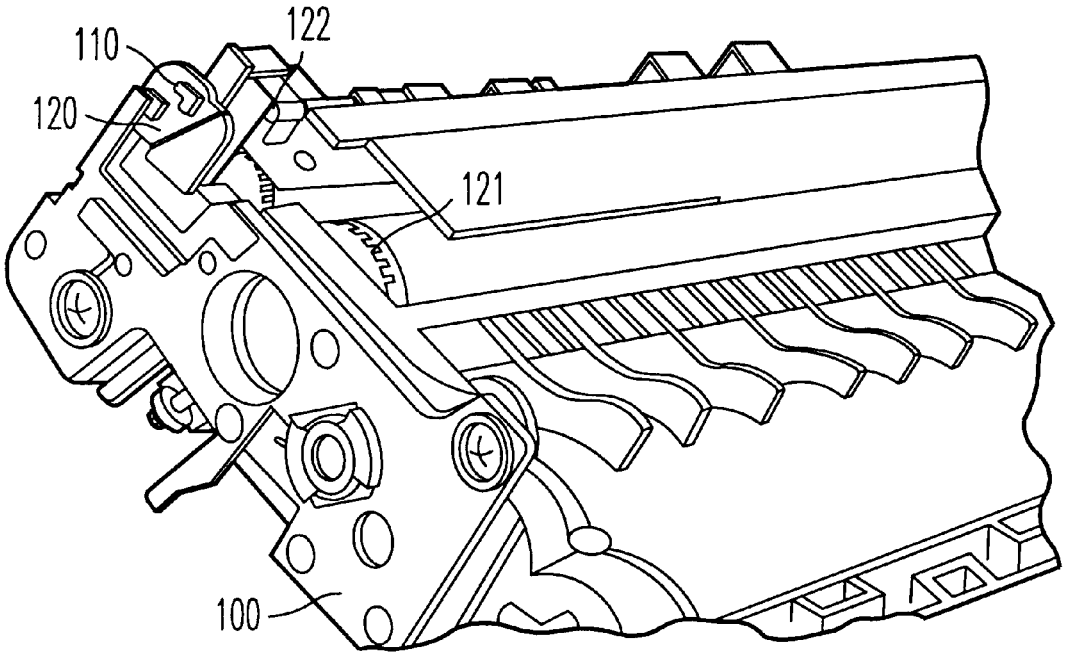
FIG. 13 is a perspective view of a bottom surface side of the photoconductive element unit in FIG. 1 showing a drive mechanism of the projection of the unused-state detection.
Figure 14A:
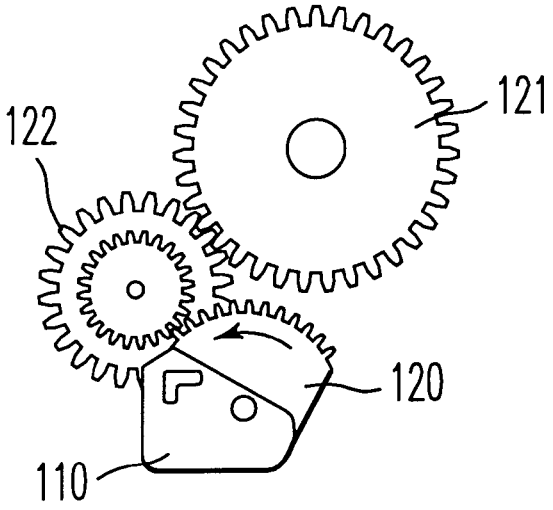
FIGS. 14(*a*) and 14(*b*) are illustrations conceptually showing a movement of the drive mechanism of the projection for the unused-state detection.
Figure 14B:
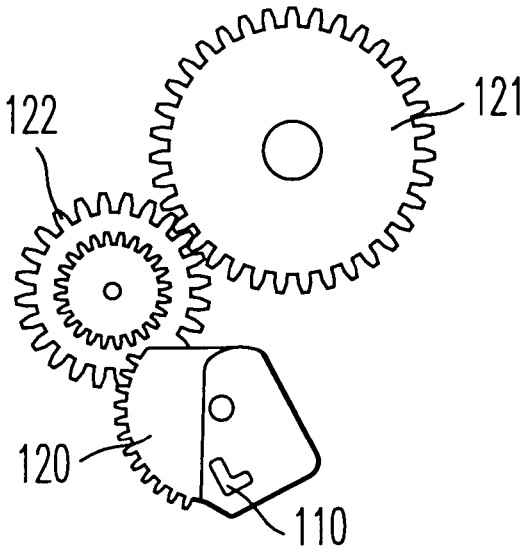

The photoconductive element unit 22 is provided with a projection 110 for detecting unused toner, a plug connector 111 for setting-detection, guide projections 112 and 113 used as an insertion guide of the main body of the image forming apparatus and are mounted as projections, and a power supply terminal 101 mounted at an end of a case of the charging device 101 as shown at the front of a case 100 in FIG. 10. Further, at a side plate 114 for a mounting portion of the photoconductive element unit 22 in the main body of the image forming apparatus, an unused-state detection switch 115, a receptacle connector 116, and a charging bias voltage applying terminal 117 are provided at the respective positions of aforementioned elements and separated by distances A, B, and C from corresponding parts of the photoconductive element unit 22, as shown in FIG. 11. Furthermore, holes 118 and 119 are formed at the side plate 114 for inserting the guide projections 112 and 113 and at relative distances C and D as shown in FIG. 12. Bias voltages are applied to the charging roller 14, developing device 2, transfer and separation device 16, and discharging device (not shown) or the like from the power supply terminal 101*a* (FIG. 11). In addition, when using the guide projection 113 not for a mounting mechanism, for example, but for a recognizing device for recognizing a kind of the image forming apparatus that accepts the photoconductive element unit 22, or the like, a shaft of the photoconductive element can be used for the guide and in this case, the hole 119, of course is not provided. The projection for unused-state detection 110 is formed with a sector gear 120 in a body that is rotatably supported at a portion of an end of a fixing device side (not shown) of the case 100 as shown in FIGS. 13 and 14, and can rotate in a plane parallel to a side face of the case 100. The sector gear 120 is engaged with a gear 121 formed at an end edge of the photoconductive element 1 via intermediate gear 122. Therefore, if the photoconductive element unit 22 is mounted in the main body of the image forming apparatus 1, the projection for unused-state detection 110 contacts the unused-state detection switch 115. When the photoconductive element 1 rotates, the projection for unused-state detection 110 rotates towards the lower part in FIGS. 10 and 14 with the sector gear 120 by the rotation of the gear 121 attached therewith and the intermediate gear 122 (in a direction indicated by an arrow in FIG. 14(*a*);

upper direction from the illustrated state in FIG. 13, counterclockwise direction).

Since the sector gear 120 does not further rotate after the sector gear 120 moves off the engaging area of the intermediate gear 122, the projection for unused-state detection 110 stays in a hanging down state (not advancing or retreating), namely, the state shown in FIG. 14(*b*). Hereupon, unused-state detection for one photoconductive element unit can be performed once since the projection for unused-state detection 110 and the unused-state detection switch 115 at a main body of the image forming apparatus side come to a non-contacting state. Note that a charging device and the power supply terminal 101*a* are omitted from FIGS. 14(*a*) and 14(*b*).

B. Toner Supply Control

The toner supply controlling operation, which is performed by the image forming apparatus control circuit 25, will be explained with reference to FIGS. 1 and 10. The image forming apparatus control circuit 25, in FIG. 1, controls turning on and turning off the drive motor 30. When the drive motor 30 is turned on, the power is transmitted to a drive part 31, and the first member 3 and the second member 4 are driven to rotate. Thus, by being rotatably driven, the first member 3 and the second member 4 agitate and convey the developer. On the contrary, when the drive motor 30 is turned off, the agitation and conveyance of the developer are stopped.

Figure 15:
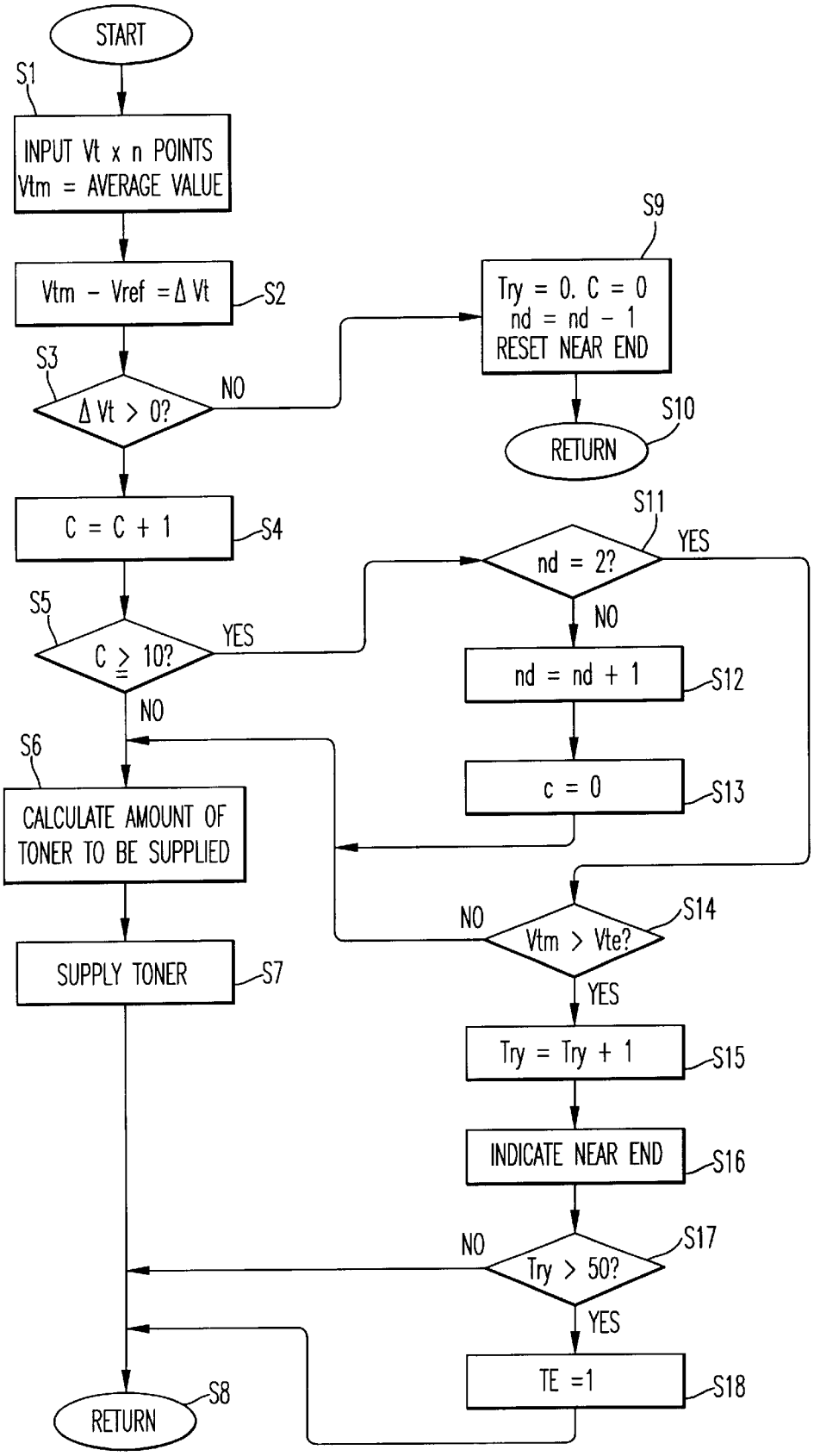
FIG. 15 is a flowchart explaining a toner density control process.

The image forming apparatus control circuit 25 performs a process shown in FIG. 15 after finishing the image forming operation for each sheet. First, a plurality of points (n points) of an output value of the toner density detecting sensor 19 are sampled, and an average value Vtm of the n points is calculated in Step S1. Next, the image forming apparatus control circuit 25 calculates a difference value ΔVt by subtracting a toner density reference value Vref from the average value Vtm (ΔVt=Vtm−Vref) in Step S2.

The image forming apparatus control circuit 25 judges whether ΔVt is equal to or greater than 0 in Step S3. Hereupon, the greater the toner density becomes, the less the output value Vt of the toner density detecting sensor 19 becomes. The image forming apparatus control circuit 25 resets count values $T_{ry}$ and C and subtracts one from the toner supplying level "nd", if ΔVt is not ΔVt>0, i.e., Vtm<Vref, since the toner density is greater than the reference value, and reset the "near end" flag if the toner is near the end state, and returns in Step S10. Further, if ΔVt becomes ΔVt>0, i.e., the toner density becomes smaller than the reference value, the image forming apparatus control circuit 25 adds one to count value C in Step S4 and judges whether C≧10 comparing the count value C with a set value, for example, 10 in Step S5.

If C is not C≧10 as determined in step S5, i.e., if the number of the continuous image forming time does not reach equal to or greater than 10 times under the state of ΔVt>0, the process proceeds to step S6 where the image forming apparatus control circuit 25 calculates the amount of the toner that is to be supplied to the developing device 2 from the toner supplying device 18. In this case, the process proceeds to step S7 where the image forming apparatus control circuit 25 changes the amount of the toner to be supplied to the developing device 2 from the toner supplying device 18 corresponding to the toner supplying level nd, the larger the nd becomes, the greater the amount of the toner. Next, the image forming apparatus control circuit 25 executes toner supplying operation of the toner supplying device 18 according to the calculated amount of the toner by controlling the toner supplying controlling section 18*b*, and returns in Step S8.

However, if in step S5 the response is affirmative, the image forming apparatus control circuit 25 judges whether nd=2, when C≧10 in Step S11, and if nd is not nd=2, the process proceeds to Step S6 after adding one to nd in step S12 and resetting count value C to 0 in Step S13. Furthermore, if in step S11 it is determined that nd=2, the image forming apparatus control circuit 25 judges whether Vtm is greater than toner end value Vte in Step S14.

If Vtm>Vte, the image forming apparatus control circuit 25 proceeds to Step S6, and when Vtm reaches the value of Vtm>Vte, the image forming apparatus control circuit 25 judges that the toner supplying device 18 has reached a toner near-end state, and adds one to the count value $T_{ry}$ in Step S15. After directing a display in the operation panel 26 to indicate that the toner supplying device 18 has reached the toner near-end state in Step S16, the image forming apparatus control circuit 25 judges whether the count value $T_{ry}$ becomes greater than a set value, for example, 50 in Step S17.

If Try>50, the image forming apparatus control circuit 25 returns in Step S17, and if Try>50, i.e., if the number of continuous image forming operation exceeds 50 times under the state of Vtm>Vte, the image forming apparatus control circuit 25 judges that the toner supplying device 18 is at a toner end state, and sets a toner end flag TE to 1 in Step S18 and then the process proceeds to Step S8 and returns. When TE=1, the image forming apparatus control circuit 25 directs the display in the operation panel 26 to indicate that a toner bottle 18*a* is to be exchanged, and after exchanging the toner bottle 18*a*, the image forming apparatus control circuit 25 resets TE to 0.

Explanation of the Toner Density Control Process Relevant to the Present Invention In FIG. 1, the image forming apparatus control circuit 25 as a control device of the present invention performs a process of storing an output value Vt of the toner density detecting sensor 19 in each image forming operation. The image forming apparatus control circuit 25 samples data for a plurality of output values (Vt) of the toner density (n points) from the toner-density sensor 19, and then averages the n points of the output values Vt to obtain an average value Vtm. The image forming apparatus control circuit 25 stores Vtm in an internal memory. This average value Vtm is updated every image forming operation.

As mentioned above, the amount of charge and the bulk of the toner decrease while the developer is left without being used for extended periods of time after being manufactured, especially in a case of the developing device using the two-component developer. If the amount of charge and the bulk of the toner decreases, the output value Vt of the toner density detecting sensor 19 varies, which gives rise to some trouble. The specifics of this relationship are explained again as follows.

Usually, at an initial setting time point, the output value Vt of the toner density detecting sensor 19 to the developer is set to about 2.0 v. However, for example, if the developer is left without being used for such an extended period of time, such as 3 months after the manufacture date, the output value of the toner density detecting sensor which is 2.0 v as a reference value (target value) after the time of manufacturing changes to, for example, 2.4 v, even though the toner density has not changed after the time of manufacturing. This is because the image forming apparatus control circuit 25 judges that the amount of the toner is insufficient, since the bulk of the toner has decreased and much of the heavy carrier-component is mainly detected with the toner detecting sensor 19 which is disposed at a lower part of the developing device and thereby the output value of the permeability of the developer at the toner density detecting sensor 19 rises, i.e., changes to for example, 2.4 v. Such a condition occurs at a time when agitation of the toner is insufficient and the image forming apparatus control circuit 25 erroneously judges that the toner density is low even though actual toner density is not low. Consequently, the image forming apparatus control circuit 25 directs the toner supplying device 18 to supply toner until the output value of the toner detecting sensor 19 reacher 2.0 v, and therefore the toner is continuously supplied. Thus the toner density becomes greater than a reference value (target value) resulting in a deterioration of the image quality.

Moreover, in the image forming apparatus of the present invention, the developer in which the amount of charge of the toner and the bulk thereof are deteriorated due to being left for extended periods of time is agitated for a predetermined time in which the output value of the toner density detecting sensor 19 reaches a level equal to or less than the reference value (target value) or until the output value of the toner density detecting sensor 19 reaches equal to or less than another reference value (target value), by sampling the output value of the toner density detecting sensor 19 at the time of initial setting.

The another reference value (target value) represents an output value of the toner density detecting sensor corresponding to a lowermost level of the charging amount which has no influence on an image quality, such as background fouling, solid image scattering, toner scattering and the like. When the developer has a charging level that is equal to or less than the certain reference value (target value), namely, in a case of using the developer having a charging level equal to or greater than the above-mentioned lowermost level, the deterioration of an image quality, such as background fouling, solid image scattering, toner scattering, and the like because of insufficient charging amount does not occur.

The initial setting time point represents the time when a developing operation is first performed by driving the developing device after an unused developer container is mounted on the developing device. The unused developer container contains an unused developer of a standard toner density value of 4 wt % in a weight of 360 g which is not used. The unused developer contained in the unused developer container satisfies a certain reference value unless the developer container is left for extended periods of time after the date of manufacture. When the developer container is left for extended periods of time after the date of manufacture, there is a high possibility that the charging amount and the bulk are deteriorated less than a certain reference value, and thus adversely influencing image quality.

Figure 4:
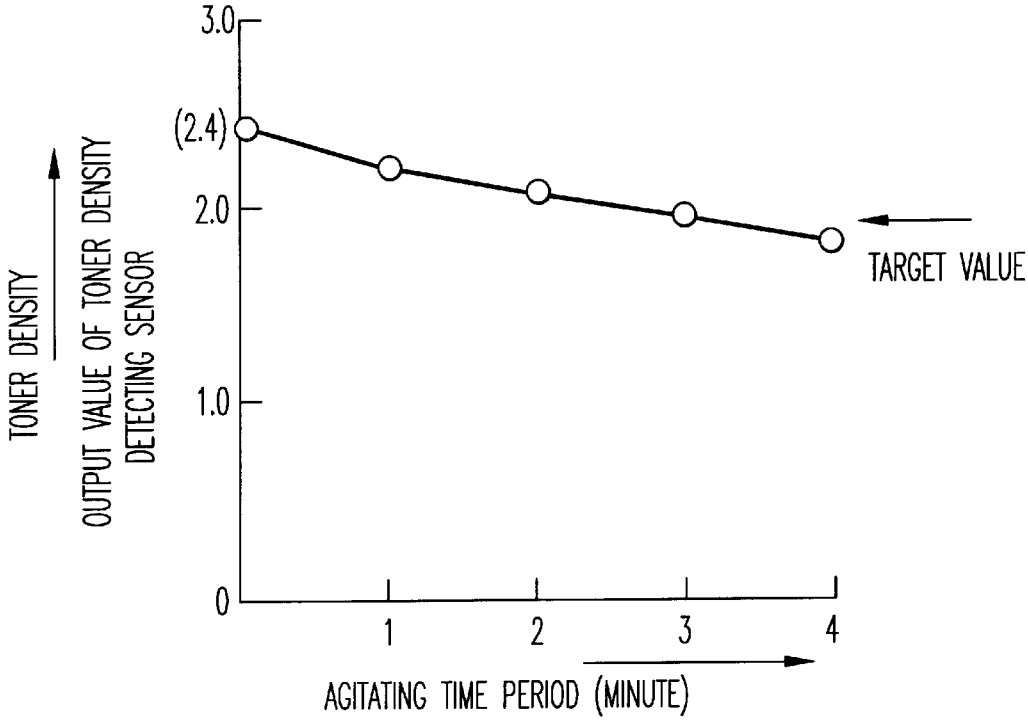
FIG. 4 in a graph of a relationship of an agitation time period and an output value of a toner density detecting sensor.

FIG. 4 is an illustration explaining a relationship of an agitating time period and an output of a toner density detecting sensor for indicating a time period, as a measure of developer agitation, that is left for extended periods of time, to recover the deterioration of the charging amount and the bulk of the toner. Referring to FIG. 4, a developer whose output value Vt of the toner density detecting sensor is 2.4 v before the agitation for initial setting is not performed can be recovered to a certain reference value (target value) equal to or less than 2.0 v of the output value thereof by agitating for 3 minutes. In accordance with the empirical results, the time period for recovering the output value of the toner density detecting sensor to a level of equal to or less than 2.0 v that is the reference value (target value) depends on the extended periods of time when the developer is left without being used. In this case, the predetermined time for agitating the developer is determined to be 3 minutes since an image of good quality without background fouling, solid image scattering, toner scattering and the like can be obtained by agitating the developer in a standard of 3 minutes when the developer left for equal to or less than 3 months is used.

First Embodiment

In this embodiment, the image forming apparatus control circuit 25 in FIG. 1 performs the first agitating mode. Further, the unused-state detection switch 115 in the main body of the image forming apparatus, and the projection for unused-state detection 110 in the developing device 2 are provided to perform the first agitating mode as described above. Accordingly, the unused-state detecting operation of the photoconductive element unit 22 is surely performed once. Furthermore, detecting that the output value of the toner detecting sensor 19 is equal to or greater than 0.5 v, it is confirmed that the developer is supplied to the developing device 2 since if the developer is not supplied to the developing devices, the output value of the toner detecting sensor 19 becomes equal to or less than 0.5 v. Furthermore, the image forming apparatus control circuit 25 is provided with a timer 33 (or timer function).

Figure 2:
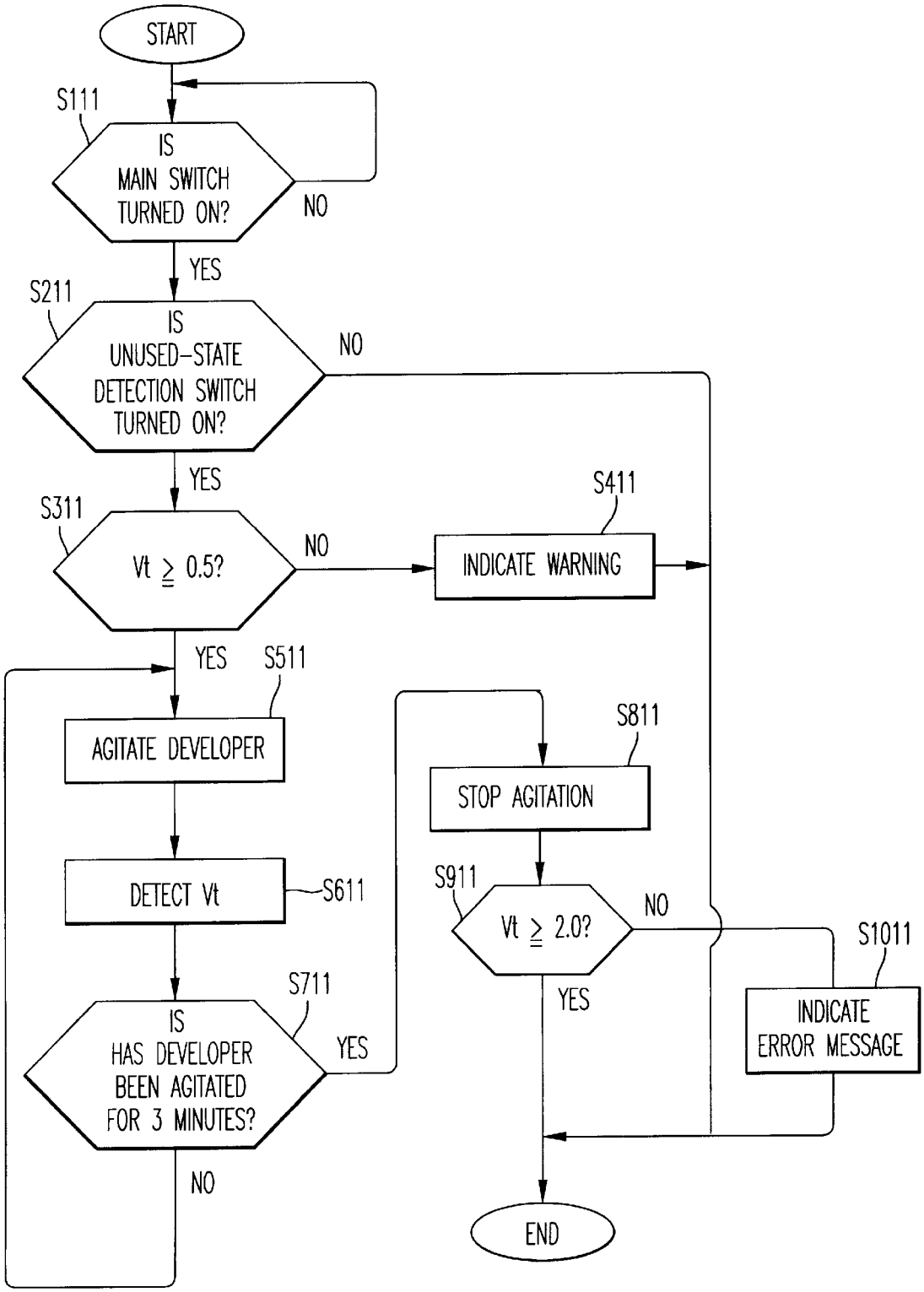
FIG. 2 is a flowchart of an unused developer agitation process according to the first embodiment of the present invention.

This embodiment is further explained referring to FIG. 2 illustrating the performing process of the first agitating mode. In Step S111, the image forming apparatus control circuit 25 judges whether the main switch of the image forming apparatus is turned on. If the main switch is turned on, the process proceeds to Step S211 and the image forming apparatus control circuit 25 judges whether the aforementioned unused-state detecting switch 115 is turned on. If the unused-state detecting switch 115 is turned on, the developer is required to be agitated after supplying the developer into the developing device 2, since the amount of charge of the toner or the bulk of the developer is decreased. Then the process proceeds to Step S311. On the other hand, if the unused-state detecting switch 115 is not turned on, this mode ends since the developer is not required to be agitated.

Next, the image forming apparatus control circuit 25 judges whether the output value Vt of the toner density detecting sensor 19 is equal to or greater than 0.5 v in Step S311. If Vt is equal to or greater than 0.5 v, the process proceeds to Step S511 and starts the agitating operation of the developer, since the developer is supplied into the developing device 2. On the other hand, if Vt is not equal to or greater than 0.5 v, the image forming apparatus control circuit 25 directs the display to indicate a warning message for an operator to pull out the heat seal 9 in Step S411, since the developer is not supplied into the developing device 2, namely when the heat seal is not pulled out. In Step S511, the image forming apparatus control circuit 25 directs the drive motor 30 to agitate the developer, and then the output value Vt of the toner density detecting sensor 19 is detected in Step S611. Further, at the same time of starting the agitating operation in Step S511, the timer 33 starts the time count.

After the time count is started with the timer in Step S511, whether 3 minutes has passed is judged in Step S711. The time period of 3 minutes is based on the aforementioned explanation in FIG. 4, where the 3 minutes is set as a predetermined time period so that the output value of the toner density detecting sensor 19 for the standard developer left for predetermined time period without using, can be achieved in the certain reference value (target value) that is equal to or less than 2.0 v.

In Step S711, the agitation in Step S511 and detecting of the output value Vt from the toner density detecting sensor 19 in Step S611 are repeatedly performed until 3 minutes passes, and when 3 minutes has passed, the process proceeds to Step S811 and the agitating operation of the developer is stopped. The process then proceeds to Step S911 where the image forming apparatus control circuit 25 judges whether the output value Vt has reached equal to or less than 2.0 v as the certain reference value (target value) that is previously detected in Step S611. If the output value has reached 2.0 v, the program ends this mode, and if the output value has not reached 2.0 v, the program proceeds to Step S1011 and directs the display in the operation panel 26 to indicate an error message. The error may be attributable to the output value not reaching the target value even though the agitation is performed for the predetermined time period. As a measure for this error message, to change the predetermined time period (3 minutes in this case) for agitating the developer or the like are considerable. The content of the error message can be set as follows.

Firstly, the message can be an indication that the apparatus requires maintenance. In this case, since the image forming operation is restarted after receiving an indication that not only is the agitation insufficient but also the irregularity of the toner density detecting sensor 19, or a similar irregularity of the control system is determined by a specialist, the toner falling down or the background fouling caused by inaccurate control based on erroneous toner density output value can be widely prevented. Further, when indicating the error message, a control for inhibiting the action of the image forming apparatus is preferably performed at the same time.

Secondly, the message can be an indication that the developer should be changed. In this embodiment, the developing device 2 can be exchanged and, by exchanging the new developing device 2, an image forming operation can be restarted using a developer in which a predetermined toner density value thereof is obtained by agitating the developer for a predetermined time period.

Thirdly, the message can be an indication that the developer is in need of a re-agitation operation. Namely, the standard developer that is left for abnormally extended periods of time does not always output the predetermined toner density value by the agitation for 3 minutes as a predetermined time. In this case, the standard developer outputs a predetermined toner density value by pressing down a re-agitation instruction button 35 by an operator according to the requirement of the directions of the re-agitation as shown in FIG. 1. Accordingly, needlessly disposing of the developer or the developing device can be prevented.

Any one of above-mentioned settings for the error treating process can prevent background fouling or toner image falling down by the erroneous detection of the toner density detecting sensor.

Further, in this embodiment, the error treatment process is performed when the output value Vt of the toner density detecting sensor 19 does not reach the value equal to or less than 2.0 v. However instead of the above case, if the process is set to handle the error treatment when the output value Vt of the toner density detecting sensor 19 does not come within a certain level, for example, 1.8 v~2.2 v, when there is an insufficient amount of the developer, abnormally high charging amount of the developer, malfunction of the toner density detecting sensor 19, or the like in which output value Vt of the toner density detecting sensor is, for example, 1.8 v can responsively be processed for error treatment.

Second Embodiment

In this embodiment, the image forming apparatus control circuit 25 performs a second agitating mode. The subject matter mentioned below relates to that of the first embodiment. To perform the second agitating mode, the unused-state detection switch 115 is mounted in the main body of the image forming apparatus. Further, the projection for the unused-state detection 110 is provided, whether to supply the developer to the developing device 2 is done by first confirming that the output value of the toner density detecting sensor 19 is equal to or greater than 0.5 v, and the image forming apparatus control circuit 25 is provided with a timer 33 (or a timer function).

Figure 3:
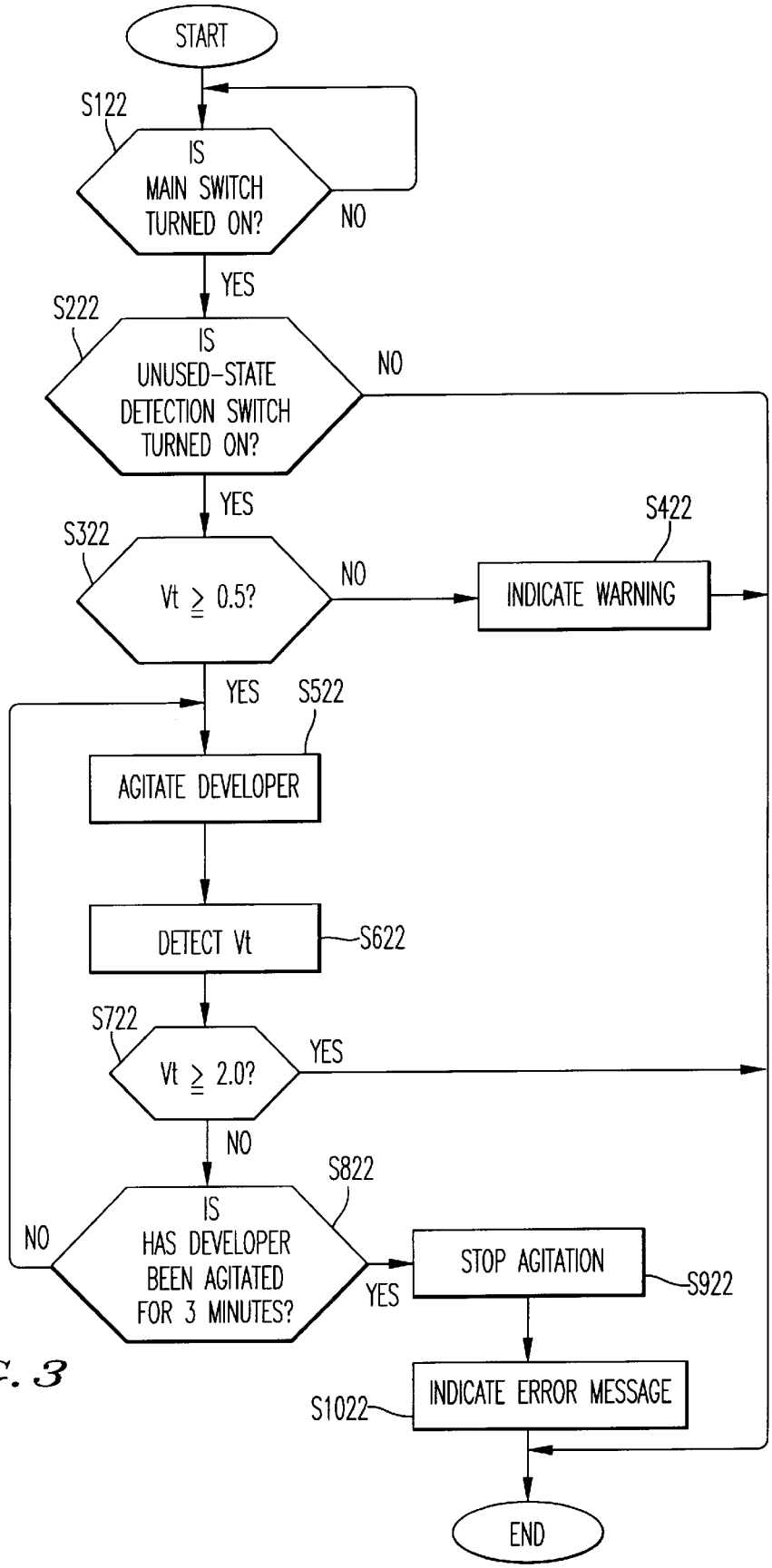
FIG. 3 is a flowchart of a used developer agitation process according to the second embodiment of the present invention.

The second embodiment is explained referring to FIG. 3 illustrating a process for performing the second agitation mode. In Step S122, it is judged whether the main switch of the image forming apparatus is turned on by the image forming apparatus control circuit 25. When the main switch is turned on, the process proceeds to Step S222 and the image forming apparatus control circuit 25 judges whether the aforementioned unused-state detecting switch 115 is turned on. If the unused-state detecting switch 115 is turned on, the photoconductive element unit 22 is in an unused-state, and the amount of charge of the toner and the bulk of the developer are decreased. Therefore, the developer is required to be agitated after being supplied to the developing device. Then the process then proceeds to Step S322. On the other hand, if the unused-state detecting switch is not turned on, this mode ends since the developer is not required to be agitated.

Next, in Step S322, it is determined whether the output value Vt of the toner density detecting sensor 19 is equal to or greater than 0.5 v by the image forming apparatus control circuit 25. If Vt is equal to or greater than 0.5 v, as the developer is supplied into the developing device 2, the process proceeds to Step S522 and starts the agitating operation of the developer. On the other hand, if Vt is not equal to or greater than 0.5, the developer is not supplied into the developing device 2, i.e., the heat seal 9 is not pulled out. Accordingly, the image forming apparatus control circuit 25 directs the display to indicate a warning message for the operator to pull out the heat seal 9. In Step S522, the image forming apparatus control circuit 25 instructs the developing device drive motor 30, and the developer is thus agitated, and the output value Vt of the toner density detecting sensor 19 is detected in Step S622. Further, the timer 33 starts a time count at the same time the agitation is started in Step S522.

In Step S722, the output value Vt that is detected in Step S622, is judged for being equal to or less than 2.0 v as a reference value (target value) by the image forming apparatus control circuit 25. If the output value is equal to or less than 2.0 v, this mode ends, and if the output value is not equal to or less than 2.0 v, then the program proceeds to Step S822 and the image forming apparatus control circuit 25 judges whether the time period has passed 3 minutes after starting the time count of the timer in Step S522. This time period of 3 minutes is determined so that an operator can accept the time period as a initial setting time period without considering it as being abnormal. Further, if the time of 3 minutes has not expired in Step S822, the program returns to S522 and continues agitating the developer.

Thus, agitation of the developer in Step S522, Vt detection in Step S622, and judging whether Vt≦2.0 in Step S722 are repeatedly performed, and when 3 minutes has passed, the program proceeds to Step S922. Proceeding to Step S922 means that the output value Vt does not reach the target reference value even though the agitation of the developer is performed for the predetermined time period. Accordingly, the image forming apparatus control circuit 25 stops agitation of the developer in Step S922, considering that some shortcomings may occur. Further, the program proceeds to Step S1022 and directs an operation panel to indicate an error message. The content of the error message can be set, as was the case for the first embodiment, all indicating the requirement of maintenance, requirement of exchanging the standard developer, requirement of instructing the re-agitation or the like. According to this embodiment, erroneous judgement by the operator due to continuously agitating the standard developer left for extended periods of time until the output value of the toner density sensor 19 reaches the target reference value can be prevented.

Obviously, numerous modifications and variations of the present invention are possible in light of the above teachings. It is therefore to be understood that within the scope of the appended claims, the invention may be practiced otherwise than as specifically described herein.

The entire contents of the priority document, JP 09-085163, filed in Japan on Apr. 3, 1997 is incorporated herein by reference.

We claim:

1. An image forming apparatus, comprising:

an image bearing member;

a latent image forming device that forms a latent image on said image bearing member;

a developing device that develops said latent image on said image bearing member to a toner image with a two-component developer so that said toner image may subsequently be transferred onto a transfer member and be output as a visible image;

a toner density detecting device configured to detect a toner density of the two-component developer and produce an output signal; and a control device configured to control an agitation of the developer for a predetermined time period during an initialization mode of operation, said control device configured to determine whether said output signal indicates said toner density is outside a predetermined range and initiate an abnormal process mode of operation if said toner density is detected as being outside of said predetermined range; and a developer containing device configured to remain mounted to the developing device after developer contained in the developer containing device is dispensed into the developing device, said developer containing device comprising a dehumidifying agent mounted therein.

2. The image forming apparatus according to claim 1, wherein said abnormal process mode of operation includes implementing a warning indication.

3. The image forming apparatus according to claim 2, wherein, the toner density of the developer is equal to or greater than 4 wt %.

4. The image forming apparatus according to claim 2, wherein an amount of the developer that may be set in said developing device is equal to or less than 400 g.

5. The image forming apparatus according to claim 1, wherein said abnormal process mode of operation includes implementing an indication that the developer is in need of being exchanged.

6. The image forming apparatus according to claim 5, wherein, the toner density of the developer is equal to or greater than 4 wt %.

7. The image forming apparatus according to claim 5, wherein an amount of the developer that may be set in said developing device is equal to or less than 400 g.

8. The image forming apparatus according to claim 1, wherein said abnormal process mode of operation includes implementing an indication that the developer is in need of being re-agitated.

9. The image forming apparatus according to claim 8, wherein, the toner density of the developer is equal to or greater than 4 wt %.

10. The image forming apparatus according to claim 8, wherein an amount of the developer that may be set in said developing device is equal to or less than 400 g.

11. The image forming apparatus according to claim 1, further comprising a re-agitation control device to control an operation of re-agitating the developer.

12. The image forming apparatus according to claim 11, wherein, the toner density of the developer is equal to or greater than 4 wt %.

13. The image forming apparatus according to claim 11, wherein an amount of the developer that may be set in said developing device is equal to or less than 400 g.

14. The image forming apparatus according to claim 1, wherein, the toner density of the developer is equal to or greater than 4 wt %.

15. The image forming apparatus according to claim 1, wherein an amount of developer that may be set in said developing device is equal to or less than 400 g.

16. An image forming apparatus, comprising:

an image bearing member;

a latent image forming device that forms a latent image on said image bearing member;

a developing device that develops said latent image on said image bearing member to a toner image with a two-component developer so that said toner image may subsequently be transferred onto a transfer member and be output as a visible image;

a toner density detecting device configured to detect a toner density of the two-component developer and produce an output signal; and a control device configured to control an agitation of the developer for a predetermined time period during said initialization mode of operation, said control device having a re-agitation control device configured to control a re-agitation operation of the developer after the agitation during the initialization mode is finished; and a developer containing device configured to remain mounted to the developing device after developer contained in the developer containing device is dispensed into the developing device, said developer containing device comprising a dehumidifying agent mounted therein.

17. The image forming apparatus according to claim 16, wherein, the toner density of the developer is equal to or greater than 4 wt %.

18. The image forming apparatus according to claim 16, wherein an amount of the developer that may be set in said developing device is equal to or less than 400 g.

19. An image forming apparatus, comprising:

an image bearing member;

a latent image forming device that forms a latent image on said image bearing member;

a developing device that develops said latent image on said image bearing member to a toner image with a two-component developer so that said toner image may subsequently be transferred onto a transfer member and be output as a visible image;

a toner density detecting device configured to detect a toner density of the two-component developer and produce an output signal; and a control device configured to control an agitation operation of the developer until said output signal reaches a predetermined range during an initialization mode of operation, said control device being configured to stop said agitation operation after a predetermined time period has expired if said output signal has not reached said predetermined range, said predetermined time period being relative to when said control device initiates said agitation operation; and a developer containing device configured to remain mounted to the developing device after developer contained in the developer containing device is dispensed into the developing device, said developer containing device comprising a dehumidifying agent mounted therein.

20. The image forming apparatus according to claim 19, wherein said control device includes a re-agitation control device configured to control another operation that re-agitates the developer.

21. The image forming apparatus according to claim 20, wherein, the toner density of the developer is equal to or greater than 4 wt %.

22. The image forming apparatus according to claim 20, wherein an amount of the developer that may be set in said developing device is equal to or less than 400 g.

23. The image forming apparatus according to claim 19, wherein, the toner density of the developer is equal to or greater than 4 wt %.

24. The image forming apparatus according to claim 19, wherein an amount of the developer that may be set in said developing device is equal to or less than 400 g.

25. A method for reviving a charge capacity of a toner in a developer, comprising the steps of:

detecting whether an unused-state detection switch determines that a photoconductive element is mounted to a main body;

detecting if a bulk of an unused amount of toner is below a predetermined level;

detecting a toner density of the developer by analyzing an output value of a toner density detecting sensor;

initiating an agitation of the developer if said toner density is outside a predetermined toner density range;

measuring an agitating time period for which the developer is agitated;

stopping the agitation of the developer after at least one of said agitating time period exceeds a predetermined time period and said toner density returns to within said predetermined toner density range;

producing at least one of an indication warning and an error message if said toner density does not return to within said predetermined toner density range after said predetermined time; and dispensing a developer from a developer container into a developing device, wherein said developer container is configured to remain mounted in said developing device after the developer is dispensed and having a dehumidifying agent mounted therein.

26. An apparatus for reviving a charge capacity of a toner in a developer, comprising:

means for detecting whether an unused-state detection switch determines that a photoconductive element is mounted to a main body;

means for detecting if a bulk of an unused amount of developer is below a predetermined level;

means for detecting a toner density of the developer;

means for initiating an agitation of the developer if the toner density is outside a predetermined toner density range;

means for measuring an agitating time period;

means for stopping the agitation of the developer after at least one of said agitating time period exceeds a predetermined time period and said toner density returns to within said predetermined toner density range;

means for producing at least one of an indication warning and an error message if said toner density does not return to within said predetermined toner density range after said predetermined time; and means for dispensing developer from a developer container into a developing device, said means for dispensing remaining mounted in said developing device after the developer is dispensed, including a dehumidifying agent mounted to said developer container.

* * * * *